US009677278B2

(12) United States Patent
Lemaitre et al.

(10) Patent No.: US 9,677,278 B2
(45) Date of Patent: Jun. 13, 2017

(54) METHOD OF FABRICATING BITUMEN IMPREGNATED RIDGE TILES, AND MACHINES FOR FABRICATING THEM

(71) Applicant: ONDULINE, Levallois-Perret (FR)

(72) Inventors: Jean-Claude Lemaitre, Sainte Marguerite sur Duclair (FR); Ethem Sakioglu, Istanbul (TR)

(73) Assignee: ONDULINE, Levallois Perret (FR)

( * ) Notice: Subject to any disclaimer, the term of this patent is extended or adjusted under 35 U.S.C. 154(b) by 676 days.

(21) Appl. No.: 14/091,484

(22) Filed: Nov. 27, 2013

(65) Prior Publication Data

US 2014/0151920 A1 Jun. 5, 2014

(30) Foreign Application Priority Data

Nov. 30, 2012 (FR) ..... 12 61478

(51) Int. Cl.
*E04D 1/30* (2006.01)
*B31F 1/07* (2006.01)
(Continued)

(52) U.S. Cl.
CPC ..... *E04D 1/30* (2013.01); *B31F 1/07* (2013.01); *B31F 1/32* (2013.01); *D06N 5/003* (2013.01);
(Continued)

(58) Field of Classification Search
CPC ..... E04D 1/30; E04D 2001/305; E04D 3/32; E04D 3/36; E04D 3/40; B31F 1/32; B31F 1/07
(Continued)

(56) References Cited

U.S. PATENT DOCUMENTS 1,489,200 A * 4/1924 Eckenfels ..... E04D 3/40 52/277
1,900,427 A * 3/1933 Clapp ..... B31B 43/00 162/117
(Continued)

FOREIGN PATENT DOCUMENTS

WO 2012/085465 A 6/2012

OTHER PUBLICATIONS

French Search Report, dated Aug. 21, 2013, from corresponding French application.

*Primary Examiner* — Alison L Hindenlang
*Assistant Examiner* — Emmanuel S Luk
(74) *Attorney, Agent, or Firm* — Young & Thompson

(57) ABSTRACT

Disclosed is a method of fabricating bitumen impregnated cellulose ridge tiles, each ridge tile having the general shape of a profiled ridge tile plate of cross-section symmetrical about a vertical longitudinal midplane and that includes a downwardly concave central ridge extended laterally on either side by a flat that terminates in a downwardly concave corrugation, the ridge tile further including a series of ribs at each longitudinal end, the panel being in the form of a section member of cross-section that is made up by juxtaposing at least two cross-sections, each identical to the cross-section of the ridge tile plate, with transverse ribs in the vicinity of the longitudinal ends of the panel and on either side of at least one virtual transverse separation line extending between longitudinal panel edges. The panel is cut along a longitudinal line between the juxtaposed ridge tile sections.

18 Claims, 4 Drawing Sheets

(51) Int. Cl.
*B31F 1/32* (2006.01)
*E04D 3/40* (2006.01)
*D06N 5/00* (2006.01)

(52) U.S. Cl.
CPC ..... *E04D 3/40* (2013.01); *E04D 2001/305* (2013.01); *Y10T 83/0405* (2015.04); *Y10T 83/9372* (2015.04)

(58) Field of Classification Search
USPC ..... 264/129, 134, 160; 425/383; 83/14, 663
See application file for complete search history.

(56) References Cited

U.S. PATENT DOCUMENTS 2,048,045 A * 7/1936 Adams ..... D21J 3/00 162/116
3,457,136 A * 7/1969 Zaadnoordijk ..... C04B 20/1018 106/235
4,668,151 A * 5/1987 Oberoi ..... B65G 49/085 198/465.3
4,940,038 A * 7/1990 O'Keefe ..... B28D 1/047 125/13.01
5,004,415 A * 4/1991 Schulz ..... B26D 7/084 264/163
5,193,423 A * 3/1993 Bakker ..... B65H 29/12 271/197
5,200,013 A * 4/1993 Traber ..... B21D 13/02 156/210
5,223,200 A * 6/1993 Schulz ..... B26D 7/084 264/145
5,713,158 A * 2/1998 Gibbs ..... E04D 3/40 52/198
5,816,014 A * 10/1998 Tzeng ..... B29C 67/246 29/897.32
5,858,418 A * 1/1999 Buchy ..... B31F 1/32 425/336
5,928,764 A * 7/1999 Costi ..... E04B 7/205 428/141
6,042,359 A * 3/2000 Costi ..... E04D 12/00 425/336
6,125,602 A * 10/2000 Freiborg ..... E04D 1/265 52/198
6,355,132 B1 * 3/2002 Becker ..... B32B 38/1808 156/260
6,743,313 B2 * 6/2004 Mischo ..... C08L 95/00 156/297
8,549,802 B2 * 10/2013 Thagard, III ..... E04D 1/28 454/365
9,249,541 B2 * 2/2016 Thomas ..... D21J 3/00
2005/0092426 A1 * 5/2005 Lammers ..... B26D 3/02 156/250
2005/0144869 A1 * 7/2005 King ..... E04F 13/185 52/418
2005/0284339 A1 * 12/2005 Brunton ..... C04B 28/02 106/713
2007/0048102 A1 * 3/2007 Tristancho ..... B28D 1/04 409/293
2009/0309263 A1 * 12/2009 Srostlik ..... E04D 1/04 264/319
2010/0192496 A1 8/2010 Koch et al.
2012/0193033 A1 * 8/2012 Nitta ..... B31F 1/26 156/446
2013/0263526 A1 10/2013 Thomas et al.

* cited by examiner

Fig.4
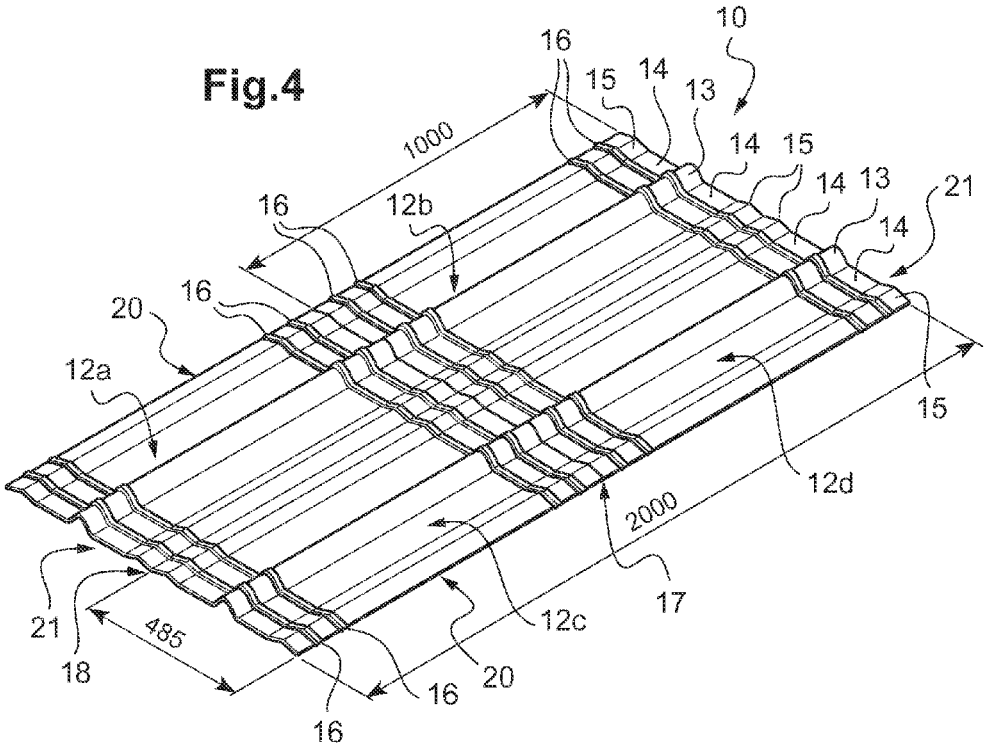
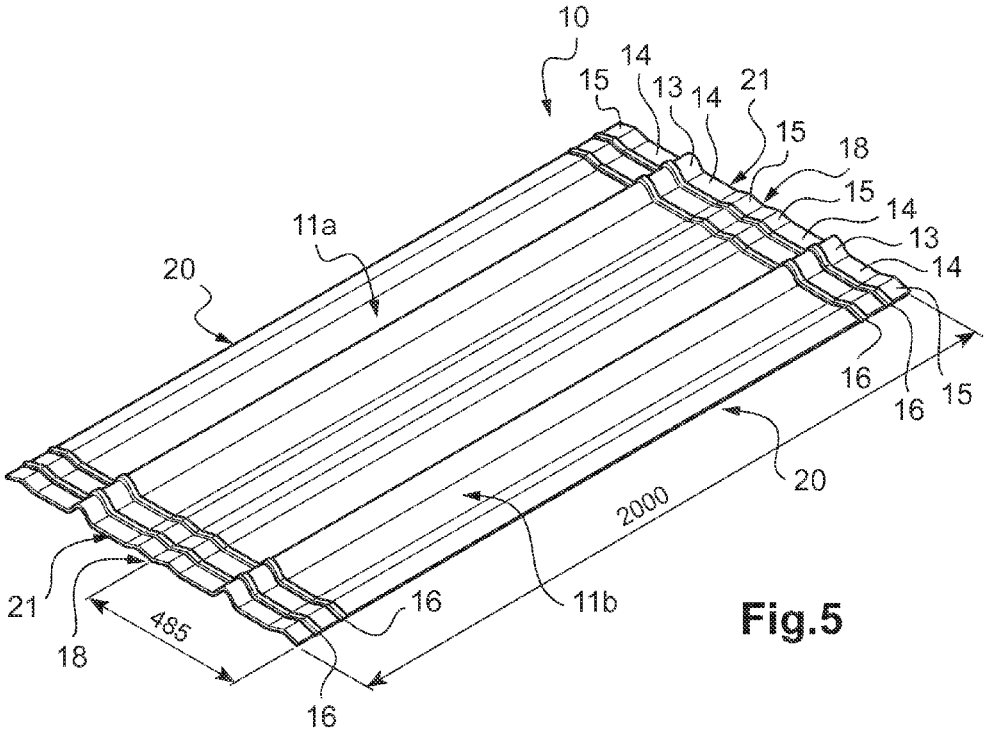
Fig.5

METHOD OF FABRICATING BITUMEN IMPREGNATED RIDGE TILES, AND MACHINES FOR FABRICATING THEM

FIELD OF THE INVENTION

The present invention relates to a method of fabricating bitumen impregnated cellulose ridge tiles, and also to machines for fabricating such ridge tiles.

BACKGROUND OF THE INVENTION

Bitumen impregnated cellulose roofing elements have been known for a long time. They are made from an aqueous composition of cellulose fibers that is dried, treated, shaped, and impregnated with hot bitumen. Various types are known such as corrugated panels and panel accessories such as ridge tiles.

Corrugated panel type elements present the advantage of being suitable for being made at least for the most part by continuous methods starting from a continuous cellulose mat of density that is sufficient for it to be stable during the process of fabricating roofing elements. That stability is the result of the fact that the continuous cellulose mat is dried at least in part while it is being worked.

The present invention relates more specifically to optimizing the fabrication of ridge tiles.

Conventional methods of fabricating ridge tiles out of bitumen impregnated cellulose have relatively low yield since a discontinuous processing step is performed in which an individual cellulose plate is pressed in a mold. This also results in a relatively large amount of handling because the elements that are treated are in the form of individual plates.

One of the difficulties encountered in performing a continuous method is the need to cut up the continuous cellulose mat into individual roofing elements. Such cutting can be a source of difficulties, in particular when the mat for cutting has already been impregnated with bitumen and/or when it presents a surface or an outline with a shape that is curved. This leads in particular to risks of the cutting machines becoming clogged and/or of the roofing elements becoming deformed.

Proposals have thus been made for machines and methods that optimize the fabrication of ridge tiles and that present a degree of versatility in the types of ridge tiles that can be obtained.

SUMMARY OF THE INVENTION

The invention relates to a method of fabricating bitumen impregnated cellulose ridge tiles, each ridge tile having the general shape of a profiled ridge tile plate of cross-section that is symmetrical about a vertical longitudinal midplane and that comprises a downwardly concave central ridge extended laterally on either side by a flat that terminates in a downwardly concave corrugation, said ridge tile further including a series of transverse ribs at each of its longitudinal ends.

According to the invention, a shaped, dried, and bitumen impregnated cellulose panel is made, the panel being in the form of a section member of cross-section that is made up by juxtaposing at least two cross-sections, each identical to the cross-section of said ridge tile plate, with series of transverse ribs being formed in the vicinity of both longitudinal ends of the panel and on either side of at least one virtual transverse separation line extending between the two longitudinal edges of the panel, and in that the shaped, dried, and bitumen impregnated panel is cut along a longitudinal line of cut situated between the juxtaposed ridge tile sections, between the corrugations of the ridge tile plates so as to form at least two ridge tile subassemblies, each including at least one ridge tile.

More generally, in order to fabricate bitumen impregnated cellulose ridge tiles, each ridge tile being elongate in shape and symmetrical about its midline along its length and including in the middle a downwardly concave ridge that is extended laterally on either side by a flat terminated in a downwardly concave corrugation, said ridge tile further including a series of transverse ribs at each of its lengthwise ends, a cellulose panel is made that is shaped, dried, and impregnated with bitumen, said panel comprising a set of ridge tile shapes that are firstly in alignment in series in a first direction of the panel (each alignment forming a ridge tile subassembly), and that are secondly juxtaposed mutually in parallel with one another in the other direction of the panel (the ridge tile subassemblies being arranged in parallel), corrugation to corrugation, and said shapes are cut apart in a cutting machine.

In various implementations of the invention, use is made of the following means that can be used on their own or in any technically feasible combination:

- the ridge tile plates are also in alignment along the length of the panel, each alignment forming a ridge tile subassembly (which may also be referred to as a strip);
- a first cutting operation is performed on the panel in its length direction between the corrugations, in order to form at least two ridge tile subassemblies;
- the longitudinal cutting of the panel is performed in a first cutting operation in a first cutting station using at least one rotary disk blade in order to form at least two ridge tile subassemblies;
- a second cutting operation is performed on the ridge tile subassemblies (or strips), transversely between the ridge tile plates, in order to obtain individual ridge tiles;
- said at least two ridge tile subassemblies as obtained in the first cutting operation are cut apart in a second operation in a second cutting station, the second cutting operation being performed is a transverse direction along the virtual transverse separation line(s);
- the second cutting station is made removable so as to make it possible either to produce ridge tiles of a first length in the absence of the second cutting operation, or else ridge tiles of a second length, shorter than the first length, in the presence of the second cutting operation;
- the transverse cutting in the second cutting station is performed by means of guillotine shears with cutting shape and counter-shape;
- for a given panel, the first and second cutting operations overlap in part, the longitudinal cutting operation between the ridge tile subassemblies not yet being terminated when the ridge tile subassemblies are cut transversely in order to produce individual ridge tile plates of second length;
- for a given panel, the first and second cutting operations do not overlap;
- the cutting shape and counter-shape are shapes corresponding to the shapes of the cross-sections of the ridge tile plates including the ridges, the flats, and the corrugations of each of them;
- a cutting machine is used having a first cutting station and a second cutting station that is removable;
- the shaped, dried, and bitumen impregnated cellulose panel comprising an assembly of ridge tile plates comprises at least two ridge tile plates per ridge tile subassembly;

the shaped, dried, and bitumen impregnated cellulose panel comprising an assembly of ridge tile plates comprises two ridge tile plates per ridge tile subassembly;

the panels measure approximately 1 meter (m)×2 m;

a ridge tile subassembly of two ridge tile plates measures approximately 2 m×0.5 m;

an individual ridge tile plate measures approximately 1 m×0.5 m;

the shaped, dried, and bitumen impregnated cellulose panel comprising an assembly of ridge tile plates comprises at least two ridge tile subassemblies, the ridge tile subassemblies being mutually parallel;

the shaped, dried, and bitumen impregnated cellulose panel comprising an assembly of ridge tile plates comprises two ridge tile subassemblies, the ridge tile subassemblies being mutually parallel;

use is made of one cutting machine for a shaped, dried, and bitumen impregnated cellulose panel comprising two ridge tile plates per ridge tile subassembly and two ridge tile subassemblies per panel, the ridge tile subassemblies being mutually parallel;

a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in the continuous cellulose mat in the second direction of said continuous mat, said shaped continuous cellulose mat subsequently being cut up into panels after shaping in said shaping machine;

the first station for forming ribs in the continuous cellulose mat has control means for making or not making on command the series of transverse ribs on either side of said at least one virtual transverse separation line extending between the two longitudinal edges of the panel;

the first station for making ribs in the continuous cellulose mat includes control means enabling the number of ribs in a series of ribs to be modified for the series of transverse ribs on either side of said at least one virtual transverse separation line extending between the two longitudinal edges of the panel;

ribs are not made on each side, i.e. on one side and on the other of each virtual transverse separation line when the transverse cutting along the virtual transverse separation line is not to be performed;

a series of ribs comprises a single rib;

a single rib is made on either side, i.e. on one side and on the other, of each virtual transverse separation line, in particular when the transverse cutting along the virtual transverse separation line is not to be performed;

a series of ribs comprises two mutually parallel ribs;

the direction of the ribs is lengthwise relative to the continuous cellulose mat;

the direction of the ridges and the corrugations is widthwise relative to the continuous cellulose mat;

the method includes a step of coating the continuous cellulose mat with a coating compound prior to passing through the shaping machine;

the coating compound comprises a curable resin;

the curable resin is cured by heating;

the curable resin is heated before shaping;

the curable resin is heated after shaping;

the coating compound includes a pigment;

the coating is performed on one side only of the continuous cellulose mat;

the coating is performed on the side of the continuous cellulose mat that is to be on the top of the roof in the roofing elements;

the coating step is performed by coating the bottom face of the continuous cellulose mat;

the coating is performed on both sides of the continuous cellulose mat;

the method includes a step of impregnating the panel with bitumen after cutting into panels the continuous cellulose mat that has been formed in said shaping machine;

the method also includes a final step of drying the shaped panel before the bitumen impregnated step;

the panel is impregnated with bitumen while hot;

the method also includes a cooling step performed after the step of impregnating the shaped panel with bitumen.

The invention also provides a machine for cutting a cellulose panel that has been shaped, dried, and impregnated with bitumen in order to produce ridge tiles, the panel being in the form of a section member of cross-section that is made up by juxtaposing at least two cross-sections, each identical to the cross-section of a ridge tile plate, with series of transverse ribs being provided in the vicinity of the longitudinal ends of the panel and on either side of at least one virtual transverse separation line extending between the two longitudinal edges of the panel, each ridge tile having a generally profiled shape of cross-section that is symmetrical about a vertical longitudinal midplane and that comprises a downwardly concave central ridge extended laterally on either side by a flat that terminates in a downwardly concave corrugation.

Said cutting machine is specially configured for performing the method of the invention for fabricating bitumen impregnated cellulose ridge tiles, and it comprises:

a first cutting station in which, in a first operation, the panel can be cut in the length direction using at least one rotary disk blade along a longitudinal line of cut situated between the juxtaposed ridge tile sections between the corrugations of the ridge tile plates in order to form at least two ridge tile subassemblies, each comprising at least one ridge tile; and a second cutting station in which, in a second operation, said at least two ridge tile subassemblies of said panel as obtained in the first operation can be cut apart in a single operation in a transverse direction along the virtual transverse separation line(s), using at least guillotine shears having cutting shape and counter-shape;

the second cutting station being removable in order to make it possible to produce either ridge tiles of a first length in the absence of the second operation, or else ridge tiles of a second length, shorter than the first length, in the presence of the second cutting operation.

The invention also provides a shaping machine for making a cellulose panel in order to produce ridge tiles and comprising a set of ridge tile plates arranged firstly in series in the first direction of the panel and secondly mutually in parallel in the other direction of the panel, each ridge tile having a generally profiled shape of cross-section that is symmetrical about a vertical longitudinal midplane and that comprises a downwardly concave central ridge extended laterally on either side by a flat that terminates in a downwardly concave corrugation, said ridge tiles further including a series of transverse ribs at each of its longitudinal ends.

Said shaping machine is specially configured for use in the method of the invention for fabricating bitumen impregnated cellulose ridge tiles, and it comprises, upstream, a first station for making ribs in a continuous cellulose mat in a first direction of said continuous mat, and downstream, a second station for making ridges and corrugations in each ridge tile plate in the second direction of said continuous mat.

In said shaping machine, the first direction, that of the ribs, is longitudinal, i.e. it extends along the length of the continuous cellulose mat, in its travel direction, with the ribs being elongate longitudinally along said continuous mat. Still in said shaping machine, the second direction, that of ridges and corrugations, is transverse, i.e. across the width of the continuous cellulose mat, the ridges and the corrugations being elongate across the width of said mat.

BRIEF DESCRIPTION OF THE DRAWINGS

Without being limited thereto, the present invention is exemplified below in the following description of embodiments and implementations given with reference to:

FIG. 4 is a perspective view of a shaped bitumen impregnated panel prior to being cut and suitable for forming two subassemblies or strips of ridge tiles (i.e. ridge tiles of a first length) or else, four individual ridge tiles (i.e. ridge tiles of a second length) if the subassemblies or strips of ridge tiles are cut apart transversely; and FIG. 5 is a perspective view of a formed bitumen impregnated panel before being cut up to form two ridge tile subassemblies that are not to be cut transversely (and thus making it possible to form two ridge tiles of a first length).

DETAILED DESCRIPTION OF THE INVENTION

Figure 1:
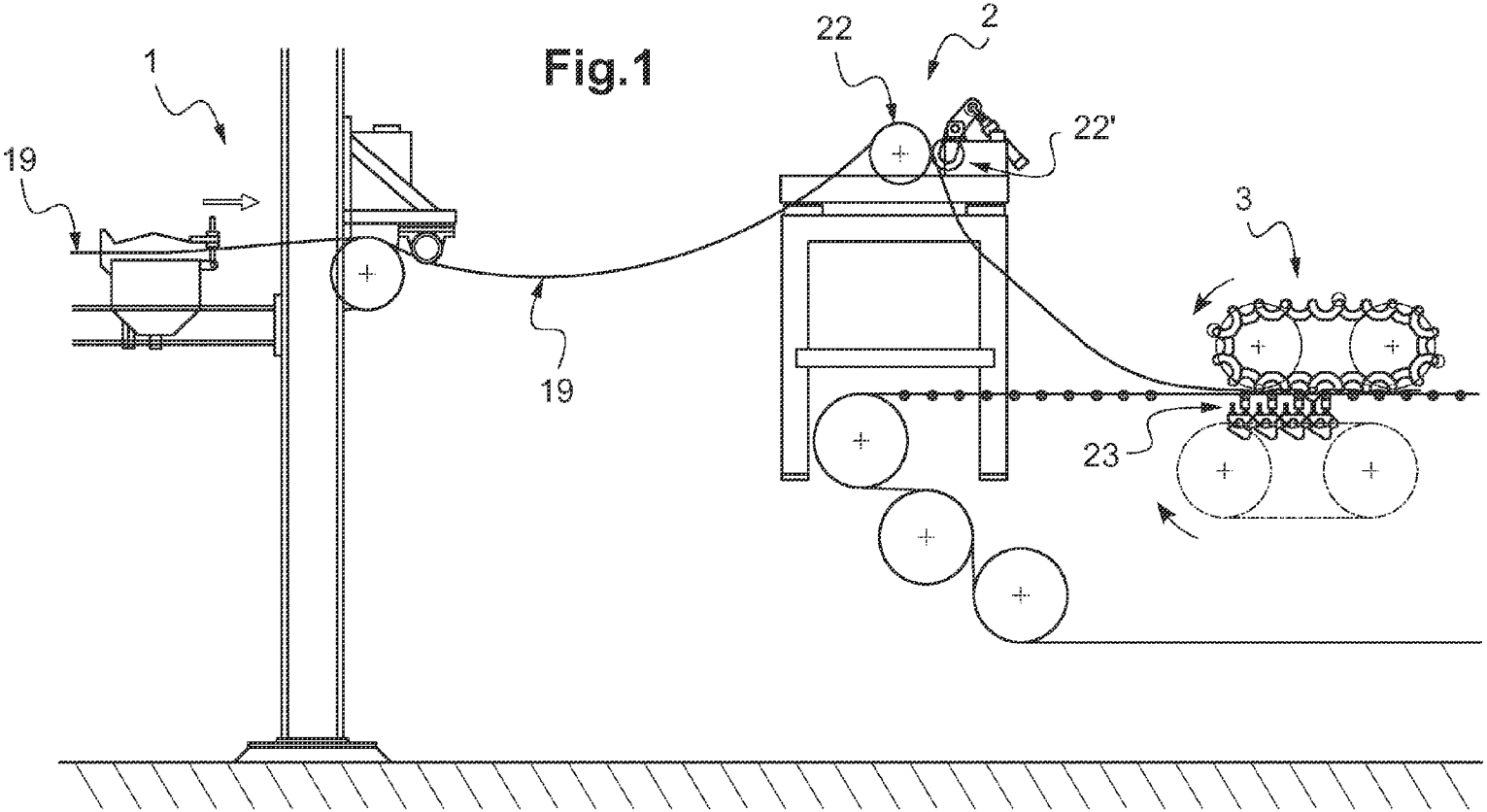
FIG. 1 which is a simplified side view of a system for coating and then forming a cellulose mat continuously with a roller and a backing roller and a corrugator.

The invention is for use in a method of fabricating bitumen impregnated cellulose ridge tiles, the method comprising the following main steps:

making a continuous mat of cellulose having a certain thickness and dried at least in part so that it can hold together while passing through the following steps;

coating the continuous cellulose mat with a coating substance, typically a resin and possibly a pigment;

shaping the continuous cellulose mat in a shaping machining in order firstly to obtain ribs and subsequently to obtain ridges and corrugations corresponding to the shapes of ridge tiles;

optionally drying the resulting continuous cellulose mat;

cutting up the resulting continuous cellulose mat into panels;

optionally drying the panel;

impregnating the panels with hot bitumen; and using a cutting machine to cut each bitumen impregnated panel into ridge tile(s) subassemblies or strips, and optionally cutting the ridge tiles subassemblies or strips into individual ridge tiles.

Preferably, between forming and impregnating with bitumen, at least one drying step is performed by heating, thus making it also possible to polymerize the coating substance.

After impregnation with bitumen, it is preferable to perform a step of cooling the impregnated panel.

Each shaped ridge tile panel has the following shape that can be seen in FIGS. 4 and 5: it is symmetrical about its longitudinal midplane along its length having, on the corresponding midline, a downwardly concave ridge 13 that is extended on either side, laterally, by a flat 14 terminated by a downwardly concave corrugation 15, said ridge tile also including at each of its two lengthwise ends 21 a series of transverse ribs 16 extending from one corrugation to the other. These ribs are designed to overlap between ridge tiles when the ridge tiles are laid in order to improve the waterproofing of the roof.

In each bitumen impregnated panel 10, the ridge plates (or more generally the individual ridge shapes) are both in alignment in series along the ridge subassemblies or strips, and also juxtaposed in parallel with one another, forming the panel of ridge tile subassemblies (strips) that are adjacent and mutually parallel. In practice, a ridge tile(s) subassembly or strip may have one or more ridge tile plates or shapes in alignment. Thus, two ridge tile subassemblies that are adjacent and thus parallel are united at 18 along corresponding corrugations of each of the ridge tile plates of said ridge tiles subassemblies. In order to obtain ridge tile(s) subassemblies or strips, the panel 10 is cut at 18 between said corrugations in the length direction of the panel. In order to obtain individual ridge tiles, each ridge tiles subassembly or strip is cut transversely, across its width, along the virtual transverse separation line 17 between two aligned ridge tile plates or shapes of said ridge tiles subassembly. This virtual transverse separation line 17 is extended between the two longitudinal edges 20 of the panel 10 and it is said to be "virtual" because it is used for explaining the location where transverse cutting of the ridge tiles subassemblies or strips is to be performed, if any such cutting is to be done.

The panel 10 is thus cut up in order to obtain ridge tile subassemblies or strips and in order to obtain individual ridge tiles in directions that are mutually perpendicular. The invention makes it possible to select between obtaining ridges tile subassemblies or strips 11*a*, 11*b*, which are thus roofing elements of great length corresponding to the first length, which great length is typically a multiple of an individual ridge tile length, and/or obtaining individual ridge tiles 12*a*, 12*b*, 12*c*, 12*d*. In a variant shown in FIG. 5, when it is desired to produce only ridge tile subassemblies or strips of the first length (and thus with no transverse cuts along the virtual transverse separation line 17), ribs are not formed between the ridge tile plates or shapes of the subassemblies or strips. In another variant of producing ridge tile subassemblies or strips (thus without any transverse cutting), only two ribs are made between the ridge tile plates or shapes of a ridge tile subassembly, instead of four ribs. In yet another variant of producing ridge tile subassemblies or strips (and thus without transverse cutting), the four ribs between the ridge tiles of a ridge tile subassembly are made, i.e. two ribs are on either side of the virtual transverse separation line 17.

Under all circumstances, the panel has at least two series of transverse ribs 16, and these two series of ribs correspond to those made at the ends 21 of the panel.

It can be understood that it is in fact possible for a ridge tile subassembly or strip to have only one ridge tile plate or shape or a plurality of them in alignment in series, and that under such circumstances it may be cut up transversely in order to produce individual ridge tiles. These various possibilities depend in particular on the size selected for each ridge tile plate or shape (which corresponds to an individual ridge tile) and on the width of the continuous cellulose mat that is formed by the forming machine.

In this implementation, the length of an individual ridge tile is 100 centimeters (cm), its width is 48.5 cm, the amplitude of the ridge 13 is 38 millimeters (mm) and the amplitude of the corrugation 15 is 15 mm. The ribs 16 are made in pairs, with the two parallel ribs of a pair being spaced apart by 83 mm and with the end rib being at 68 mm from the width edge of the ridge tile.

With reference to FIG. 1 there follows a description of the installation, beginning from the left with the arrival of a continuous mat 19 of still-wet cellulose that passes through a first machine 1 for coating it with resin and possibly also pigment from the underside of the continuous cellulose mat. The resin and the pigment, if any, penetrate into the continuous mat of cellulose. Thereafter, the continuous cellulose mat 19 passes through a second machine 2 with a system of rollers 22 and of backing rollers 22' for making the ribs or bulges on said continuous mat by an embossing operation. Some of the rollers and backing rollers are movable so as to enable some of the ribs to be made or not made depending on requirements. As described with reference to FIG. 5, it is possible to make elongate ridge tiles (a subassembly with a first length ridge tile), and under such circumstances there is no need to have ribs between two ridge tile plates or shapes in series as it is when it is desired to produce individual ridge tiles of second length.

The ribs are elongate in the length direction of the continuous cellulose mat, i.e. in the travel direction of the continuous cellulose mat through the second machine.

Thereafter, the continuous cellulose mat passes through the corrugating portion 3 of the second machine. This corrugator is constituted by two parallel shafts driven in rotation in the same direction and corrugating bars 23 that impart corrugating movement of the bars for making the ridges and the corrugations that are elongate transversely in the width direction of the continuous cellulose mat.

Figure 2:
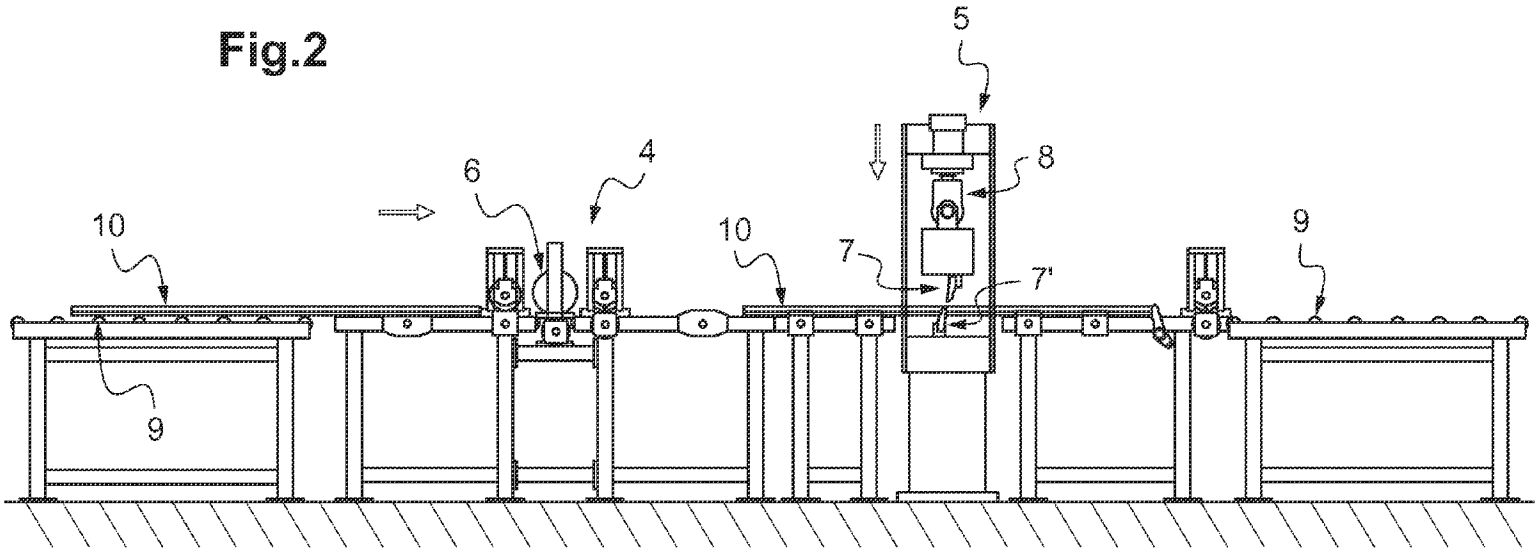
FIG. 2 is a simplified side view of a system for making longitudinal and transverse cuts.
Figure 3:
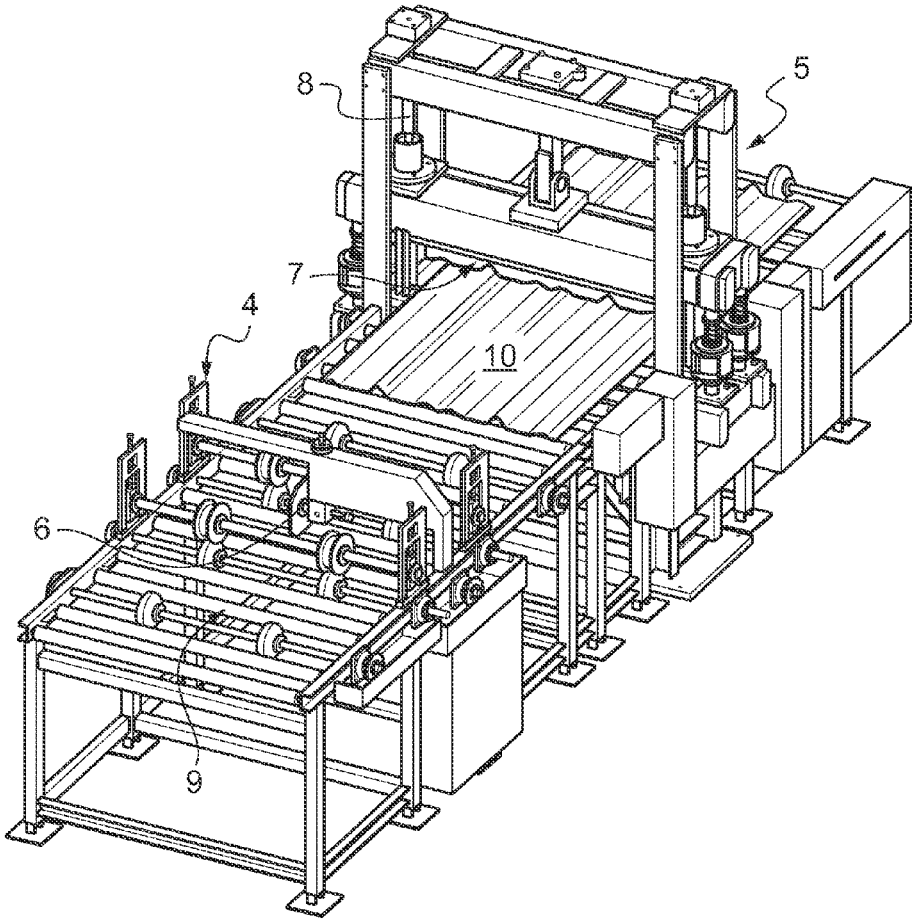
FIG. 3 is a perspective view from above, beside, and downstream of a system for making longitudinal and transverse cuts.

At the outlet from the second machine, the continuous cellulose mat has been shaped and panels are cut out from said continuous shaped mat. If necessary, final drying of the cellulose is performed before impregnating the panels with bitumen. The bitumen impregnated panels then pass through a third machine for cutting, as shown in FIGS. 2 and 3.

Thus, prior to entering the third machine, the initially continuous cellulose mat has been subjected to being cut up into individual panels and it is these bitumen impregnated panels that enter said third machine for cutting up. Preferably, it is the panels that are impregnated with hot bitumen and the shaped continuous mat is thus cut up into panels before being impregnated with bitumen. Preferably, the cellulose panels, made up of ridge tile plates or shapes as a result of the continuous cellulose mat being shaped and cut up into panels, are themselves dried before being impregnated with bitumen.

Between the second and third machines, the panels are oriented so that the ridges and corrugations that extend it transversely relative to the continuous cellulose mat 19 as a result of shaping in the second machine extend longitudinally on the bitumen impregnated panel, i.e. in the travel direction of the bitumen impregnated panel through the third machine.

The panels in question, which are impregnated with bitumen, thus comprise a plurality of ridge tile plates/shapes arranged in series and in parallel, and the third machine separates these ridge tile plates or shapes. In the third machine for cutting, the first or upstream cut 4 on the left-hand side in FIGS. 2 and 3 extends longitudinally in order to obtain ridge tile(s) subassemblies or strips, and the second cut 5, made further downstream in the right-hand side, extends transversely in order to obtain individual ridge tiles. The panels 10 travel on roller means 9 and they are driven by drive means through the third machine.

The longitudinal or upstream cutting 4 of the bitumen impregnated panel is performed between the corrugations, along the line 18 (FIGS. 4 and 5) of the panel comprising the ridge tile plates or shapes. This longitudinal cutting is performed by a rotary circular blade 6 and it enables ridge tile(s) subassemblies to be obtained. For a panel corresponding to that shown in FIG. 5, two subassemblies are obtained each corresponding to one long ridge tile 11*a*, 11*b*.

The presence of the corrugations and ridges makes it difficult to cut the ridge tile subassembly transversely with conventional methods, and in order to perform the transverse cutting downstream, a cutting system is therefore implemented that uses a blade 7 and a counter-blade 7' (visible in FIG. 2), driven by hydraulic actuators 8 in a guillotine cutter 5. This transverse cutting that takes place between the ridge tile plates or shapes along the line 17 (FIG. 4) is optional: if it is not performed, ridge tile(s) subassemblies or strips 11*a*, 11*b* are obtained (from the panel of FIG. 5 with these references, but the same is possible with the panel of FIG. 4), which subassemblies or strips are long, whereas if the transverse cutting is performed, individual ridge tiles 12*a*, 12*b*, 12*c*, 12*d* are obtained (more particularly from the panel of FIG. 4), which are short. It is indicated that this transverse cutting is optional by the second cutting station being said to be removable, and it can readily be understood that depending on the structure of this second cutting station, the absence of cutting may be obtained by not operating the second cutting station so as to allow the ridge tile subassemblies or strips to pass freely therethrough, and/or by retracting this second cutting station.

Naturally, the present invention is not limited to the particular embodiments described above, but extends to all variants and equivalents in accordance with its spirit. Thus, it can readily be understood that the invention may be organized in numerous other configurations without thereby going beyond the ambit defined by the description and the claims. Thus, the number of ridge tile plates or shapes along an alignment in series (corresponding to a ridge tile(s) subassembly or strip) in a panel may be adapted to needs and/or to available machines from a single plate or shape to a plurality of ridge tile plates or shapes in series along the ridge tile subassembly, typically two ridge tile shapes or plates in series, as shown in FIG. 4. Likewise, the number of ridge tile plates or shapes that are juxtaposed in parallel in a plate may be adapted to needs and/or to available machines from one only to a plurality of parallel juxtapositions, typically only one juxtaposition (corresponding to two mutually parallel ridge tile(s) subassemblies in the panel), as shown in FIGS. 4 and 5.

The invention claimed is:

1. A method of fabricating bitumen impregnated cellulose ridge tiles, each ridge tile having the general shape of a profiled ridge tile plate of cross-section that is symmetrical about a vertical longitudinal midplane, and that comprises a downwardly concave central ridge extended laterally on either side by a flat that terminates in a downwardly concave corrugation, said ridge tile further including a series of transverse ribs at each of its longitudinal ends, the method being wherein a shaped, dried, and bitumen impregnated cellulose panel is made, the panel being in the form of a section member of cross-section that is formed by juxtaposing at least two cross-sections, each identical to the cross-section of said ridge tile plate, with a series of transverse ribs being formed in the vicinity of both longitudinal ends of the panel and on either side of at least one virtual transverse separation line extending between the two longitudinal edges of the panel, and in that the shaped, dried, and bitumen impregnated panel is cut along a longitudinal line of cut situated between the juxtaposed ridge tile sections, between the corrugations of the ridge tile plates so as to form at least two ridge tile subassemblies, each including at least one ridge tile.

2. The method according to claim 1, wherein the longitudinal cutting of the panel is performed in a first cutting operation in a first cutting station using at least one rotary disk blade in order to form said at least two ridge tile subassemblies.

3. The method according to claim 2, wherein said at least two ridge tile subassemblies obtained in the first cutting operation are cut apart in a second operation in a second cutting station, the second cutting operation being performed in a transverse direction along the virtual transverse separation line(s).

4. The method according to claim 3, wherein the second cutting station is configured to be removable so as to make it possible either to produce ridge tiles of a first length in the absence of the second cutting operation, or else ridge tiles of a second length, shorter than the first length, in the presence of the second cutting operation.

5. The method according to claim 3, wherein the transverse cutting in the second cutting station is performed by guillotine shears with cutting shape and counter-shape.

6. The method according to claim 5, wherein the cutting shape and counter-shape are shapes corresponding to the shapes of the cross-sections of the ridge tile plates including the ridges, the flats, and the corrugations of each of them.

7. The method according to claim 1, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

8. The method according to claim 7, further comprising a step of controlling, at the first station, making or not making the ribs in the continuous cellulose mat, the ribs being a series of transverse ribs on either side of said at least one virtual transverse separation line extending between the two longitudinal edges of the panel.

9. The method according to claim 7, wherein the first direction is lengthwise relative to the continuous cellulose mat, and the second direction is widthwise relative to the continuous cellulose mat.

10. The method according to claim 7, further comprising a step of coating the continuous cellulose mat with a coating compound prior to passing through the shaping machine.

11. The method according to claim 7, further comprising a step of impregnating the panel with bitumen after cutting into panels the continuous cellulose mat that has been formed in said shaping machine.

12. The method according to claim 4, wherein the transverse cutting in the second cutting station is performed by guillotine shears with cutting shape and counter-shape.

13. The method according to claim 2, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

14. The method according to claim 3, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

15. The method according to claim 4, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

16. The method according to claim 5, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

17. The method according to claim 6, wherein a continuous forming machine is used acting on a continuous cellulose mat that is at least partially dried, the machine comprising, upstream, a first station for making ribs in the continuous cellulose mat in a first direction relative to said continuous mat, and downstream, a second station for making ridges and corrugations in said continuous cellulose mat in the second direction of said continuous mat, said shaped continuous cellulose mat subsequently being cut up into panels after shaping in said shaping machine.

18. The method according to claim 7, further comprising a step of coating the continuous cellulose mat with a coating compound prior to passing through the shaping machine.

* * * * *